United States Patent [19]

Kuppenheimer, Jr. et al.

[11] Patent Number: 4,816,694

[45] Date of Patent: Mar. 28, 1989

[54] RADIATION SYSTEM

[75] Inventors: John D. Kuppenheimer, Jr., Tewksbury, Mass.; John W. Kenne, Jr., Amherst, N.H.

[73] Assignee: Sanders Associates, Inc., Nashua, N.H.

[21] Appl. No.: 94,068

[22] Filed: Aug. 31, 1987

Related U.S. Application Data

[63] Continuation of Ser. No. 765,750, Aug. 15, 1985.

[51] Int. Cl.[4] ..... F21V 7/12

[52] U.S. Cl. ..... 250/504 R; 362/241; 362/282; 250/494.1; 250/495.1

[58] Field of Search ..... 250/493.1, 494.1, 495.1, 250/503.1, 564 R, 503–504; 362/237, 240–241, 247–248, 277, 279, 282, 296; 350/612, 613, 616, 629

[56] References Cited

U.S. PATENT DOCUMENTS

| | | | |
|---|---|---|---|
| 4,177,384 | 12/1979 | Wolff | 250/494.1 |
| 4,287,554 | 9/1981 | Wolff | 362/241 |
| 4,344,111 | 8/1982 | Rund et al. | 362/241 |
| 4,367,519 | 1/1983 | Houghton et al. | 362/304 |
| 4,388,675 | 6/1983 | Lewin | 362/241 |
| 4,425,604 | 1/1984 | Imai et al. | 362/241 |
| 4,441,783 | 4/1984 | Houghton et al. | 362/297 |
| 4,575,786 | 3/1986 | Roberts | 362/279 |

FOREIGN PATENT DOCUMENTS

| | | | |
|---|---|---|---|
| 3124335 | 1/1983 | Fed. Rep. of Germany | 250/504 R |
| 0805860 | 9/1936 | France | 362/296 |
| 2305828 | 10/1976 | France | 250/493.1 |
| 0523262 | 4/1955 | Italy | 362/241 |
| 0031236 | 3/1978 | Japan | 250/493.1 |

OTHER PUBLICATIONS

"Solar Concentrators with Maximal Concentration for Cylindrical Absorbers", by Ari Rabi Applied Optics, vol. 15 #, Jul. 7, 1976.

*Primary Examiner*—Craig E. Church
*Assistant Examiner*—John C. Freeman
*Attorney, Agent, or Firm*—Richard I. Seligman

[57] ABSTRACT

A radiation system consists of a compound collection/-beamforming system, surrounding a source of radiation, including an elevation collector/beamformer shaped as a compound parabolic concentrator and an azimuth collector/beamformer shaped so that tangential rays emanating from the source will be collected and formed into a beam of a predetermined design, and a modulator for alternately blocking and unblocking the beam from the compound collection/beamforming system.

9 Claims, 5 Drawing Sheets

RADIATION SYSTEM

This application is a continuation of application Ser. No. 765,750, filed Aug. 15, 1985.

BACKGROUND OF THE INVENTION

This invention relates to radiation systems and, more particularly, to radiation systems employing a collector/beamformer to maximize the amount of radiation which can be gathered from a source and formed into a beam.

Prior to the present invention, modulated infrared radiation systems employed relatively simple collector/beamformers to gather radiation from, for example, in an infrared radiation system, an electrically heated cylindrical rod and shape it into a beam. Typical collector/beamformers were circular or elliptical in shape. Such configurations, however, do not collect substantially all of the radiation from the source, that is they have relatively poor collection efficiency. Some of the collected radiation is prevented from being transmitted in the beam as the radiation source itself blocks radiation from the collector/beamformer. Also the directivity of the beam formed by the collectors is less than optimum.

Accordingly, it is an object of this invention to provide improved optical collector/beamformers.

It is another object of this invention to provide optical collector/beamformers which are both efficient and provide desired beam shaping.

SUMMARY OF THE INVENTION

Briefly, highly efficient optical collector/beamformers are provided which permit the tangential rays emanating from a source of radiation to be collected and redirected into a predetermined angle. The collector/-beamformers are compound and made up of an elevation optical collector/beamformer and an azimuth optical collector/beamformer. The elevation optical collector/beamformer forms the beam in elevation and its shape is that of a compound parabolic concentrator. The azimuth optical collector/beamformer forms the beam in azimuth and is so structured that the tangential rays emanating from the source will be collected and emitted into the design angle of the radiated beam.

The beam(s) generated by the compound collector/-beamformers are modulated by, for example, squirrel cage or belt modulators.

BRIEF DESCRIPTION OF THE DRAWINGS

The above-mentioned and other features and objects of this invention will become more apparent by reference to the following description taken in conjunction with the accompanying drawings, in which.

DESCRIPTION OF PREFERRED EMBODIMENTS

Figure 1:
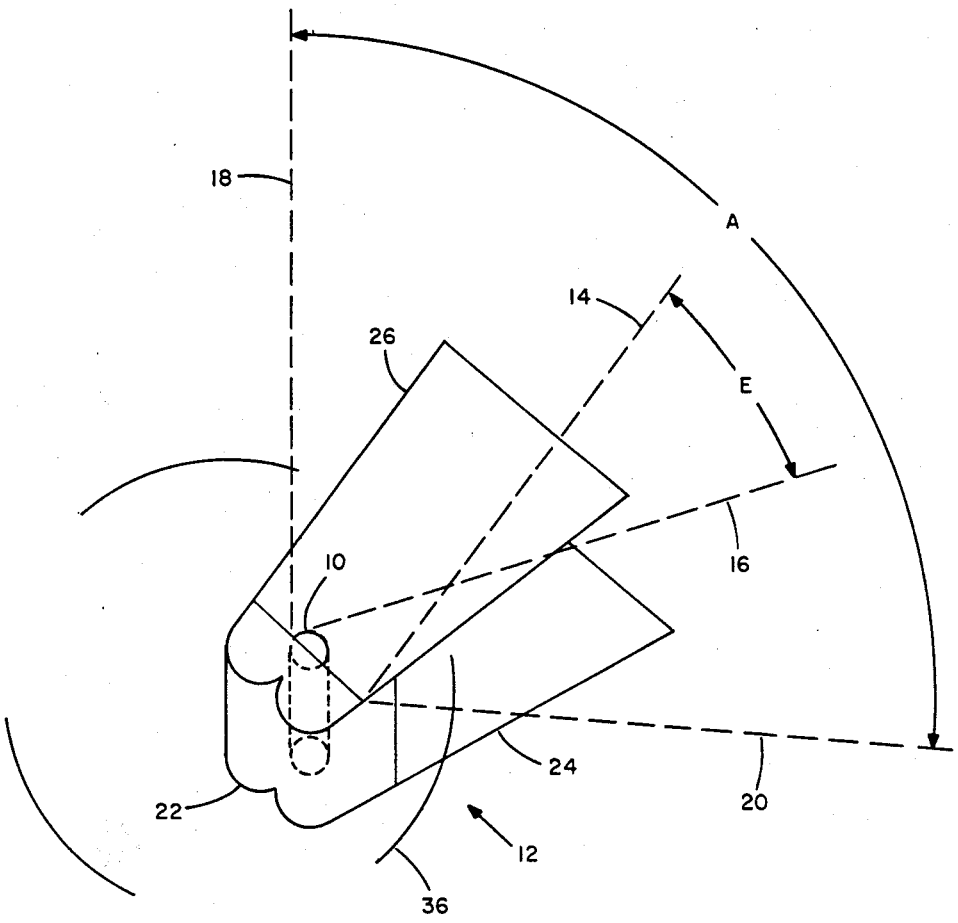
FIG. 1 is a perspective view of a compound collection/beamforming system configured according to the principles of this invention.

Referring now to FIG. 1 of the drawings, there is illustrated thereby a system for maximizing the amount of radiation which can be collected from a source and re-radiated as a beam. The energy from a radiating source 10 is received by a compound collection/beamforming systems 12 to generate a beam of energy which in elevation radiates into an angle E as represented by the dashed lines 14 and 16 and in azimuth radiates into an angle A as represented by the dashed lines 18 and 20. The compound collection/beamforming system includes an azimuth optical collector/beamformer 22 and an elevation optical collector/beamformer 24,26.

Figure 2:
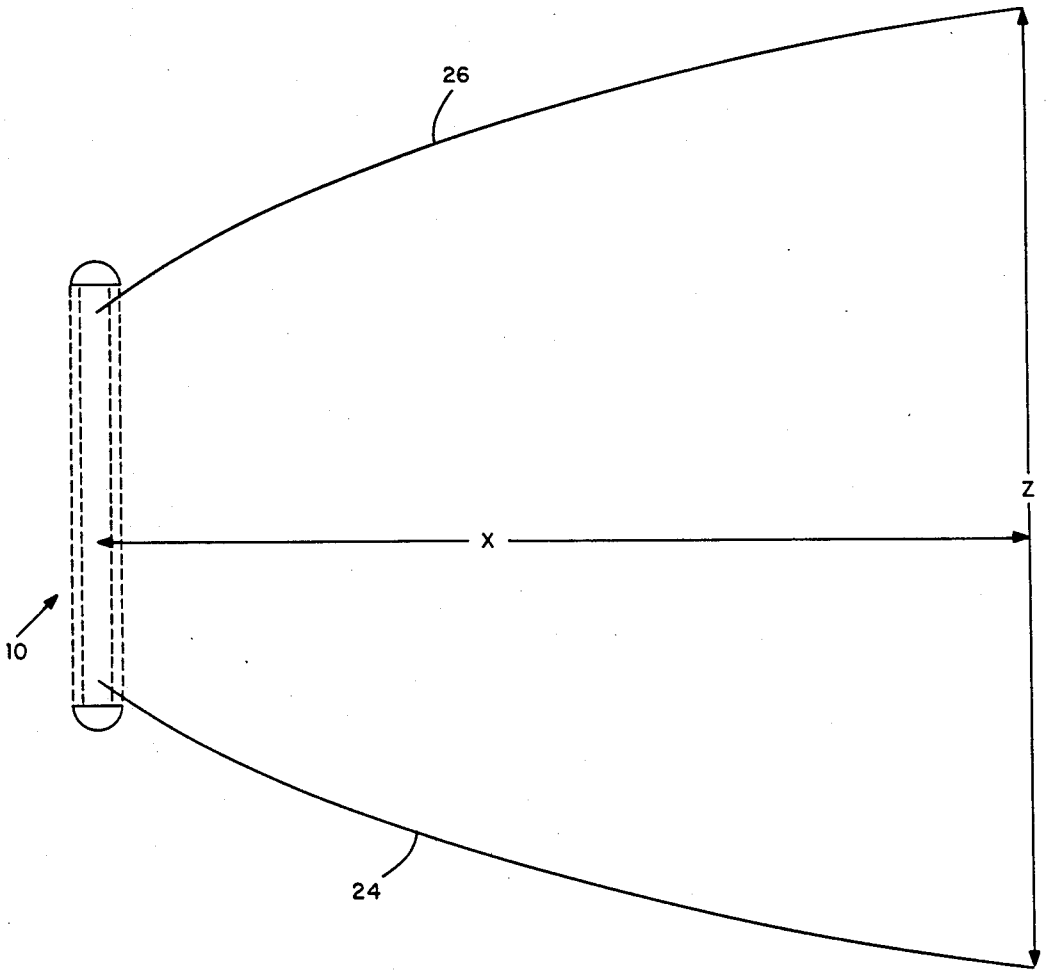
FIG. 2 is a side view of the elevation optical collector/beamformer of the compound collection/beamforming system of FIG. 1.

A side view of the elevation optical collector/beamformer is illustrated in greater detail in FIG. 2 to better show its location with respect to source 10. The shape of the elevation optical collector/beamformer is that of a compound parabolic concentrator. In one typical design an elevation optical collector/beamformer with an x dimension of 30.7 cm. and a Z dimension of 30.5 cm produced an elevation beam of approximately $\pm 20°$.

Figure 3:
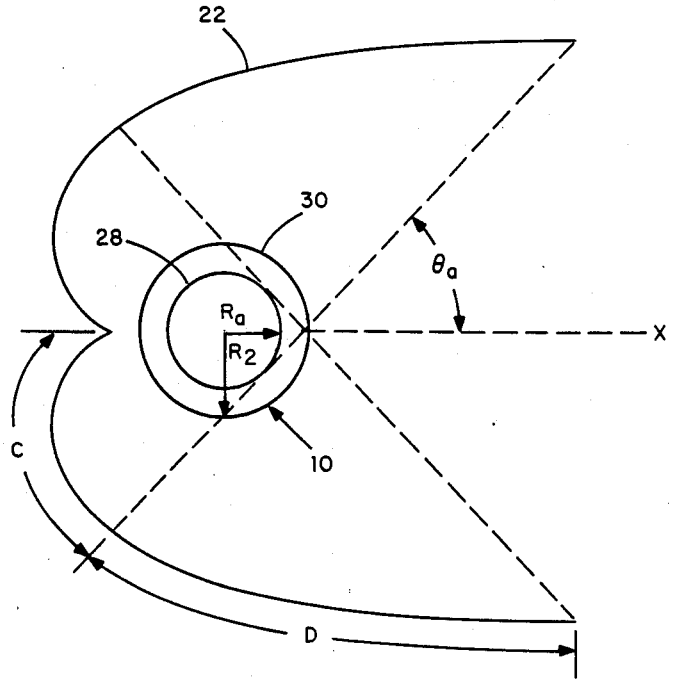
FIG. 3 is a top view of the azimuth optical collector/-beamformer of the compound collection beamforming system of FIG. 1.

The azimuth optical collector/beamformer is much more complex and the design thereof is explained in conjunction with the top view thereof shown in FIG. 3. FIG. 3 illustrates a top view of azimuth optical collector/beamformer 22 surrounding source 10 which includes the actual source of radiant energy such as, for example, for an infrared radiation system, an electrically heated carbon rod 28, and its housing 30. For other spectral regions other sources would be employed. For example, for an ultraviolet system, source 10 could be an arc lamp. Typically the carbon rod is heated within an atmosphere which prevents combustion such as pure nitrogen or a nitrogen/argon combination. The housing 30 is typically silicon which is transmissive in the infrared. For other spectral regions, housing 30 is made of a material which is transmissive in the region of interest. The cusp of the azimuth optical collector/beamformer is positioned close to envelope 30 but separated therefrom so as not to break the envelope during, for example, vibration of the system.

Two different formulas are used to generate the configuration of the azimuth optical collector/beamformer. The configuration is divided into two curves C and D with their dividing line at a point determined by drawing a line tangential to rod 28 so as to make an angle $\theta_a$ with the x axis where $\theta_a$ is the half angle of the desired azimuth beam width ($\frac{1}{2}$ of A of FIG. 1).

The formula for curve C is:

$$\rho = R_a(\theta + \theta_d)\ 0 \leqq \theta \leqq \theta_a + \pi/2$$

and the formula for curved D is:

$$\rho = R_a\left[\frac{\theta + \theta_a + 2\theta_d + \pi/2 - \mathrm{Cos}(\theta - \theta_a)}{1 + \mathrm{Sin}(\theta - \theta_a)}\right]$$

$$\theta_a + \pi/2 \leqq \theta \leqq \frac{3\pi}{2} - \theta_a$$

$\theta$ is the angle measured from the x axis to a radius of the source.

$\rho$ is the distance from the end of a radius to the point of interest.

Figure 4:
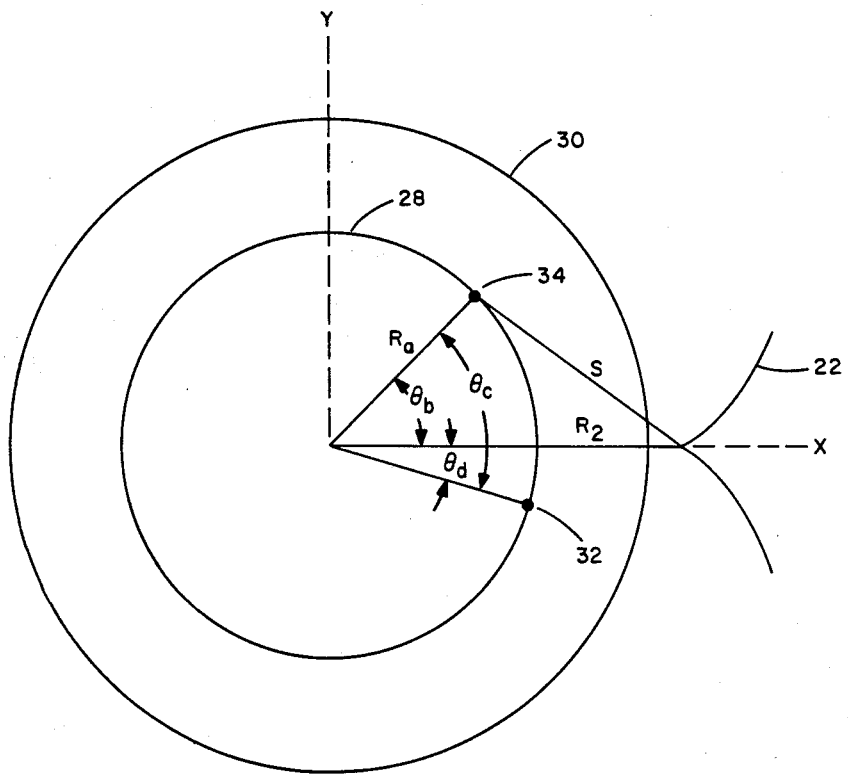
FIG. 4 is a drawing illustrating the various angles and other parameters used to explain the manner in which the azimuth optical collector/beamformer is designed.

$\theta_a$ has previously been defined. $\theta_d$ is determined from the following formulas as described in conjunction with FIG. 4.

$$S = \sqrt{R_2^2 - R_a^2}$$

$$\theta_c = S/R_a$$

$$\theta_c = \sqrt{\frac{R_2^2}{R_a^2} - 1}$$

$$\theta_b = \mathrm{Cos}\frac{-1R_a}{R_2}$$

$$\theta_d = \theta_c - \theta_b$$

$$\theta_d = \sqrt{\frac{R_2^2}{R_a^2} - 1} - \mathrm{Cos}\frac{-1R_a}{R_2}$$

Point 32 is determined by taking the length of line S and running a similar length line from point 34 to a point, 32, on the outer perimeter of source 28.

Such configurations have been suggested for use as solar collectors in an article by Ari Rabl in the July 1976 issue of Applied Optics (Vol. 15, No. 7, pages 1871–1873).

Figure 5:
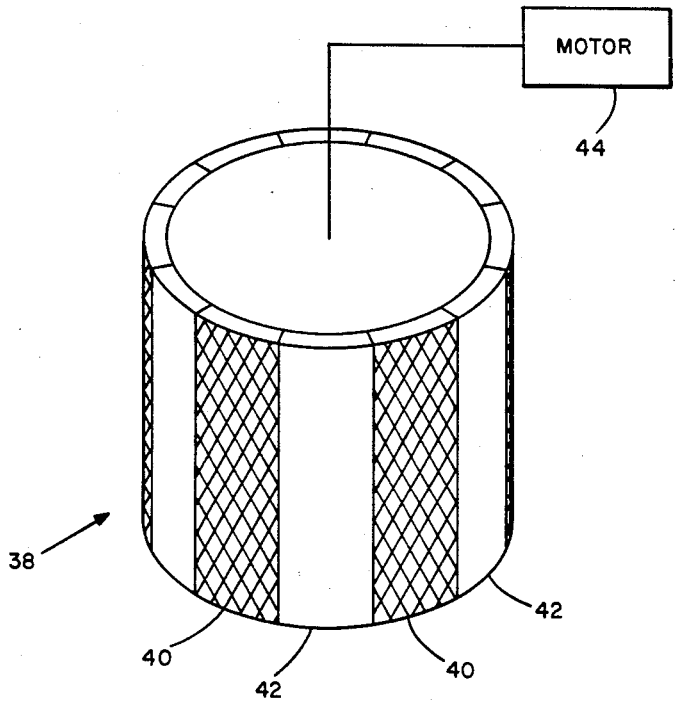
FIG. 5 is a three dimensional drawing of a squirrel cage modulator used to modulate the output from the compound collection/beamforming system of FIG. 1.

Compound collection/beamforming system 12 provides good collector efficiency, good directivity and desirable waveforms in a relatively small space and is of relatively light weight. The output from such a system is readily modulated by utilizing a squirrel cage modulator. The squirrel cage modulator would be positioned vis-a-vis the collection/beamforming system as illustrated by the dashed lines 36 in FIG. 1 which represent the top of the modulator. A typical complete modulating element is illustrated in FIG. 5. This modulator 38 is cylindrical and made up of opaque sections 40 and transparent sections 42 such that when caused to rotate it alternatively blocks and unblocks the radiation from the compound collection/beamforming system 12 thereby modulating the radiation emitted from the source 10. Typically filtering is used with the transparent sections 42 to limit the transmitted radiation to a spectral band of interest. The modulator 38 is driven by a motor 44 in conventional fashion, details of which are shown only schematically.

Figure 6:
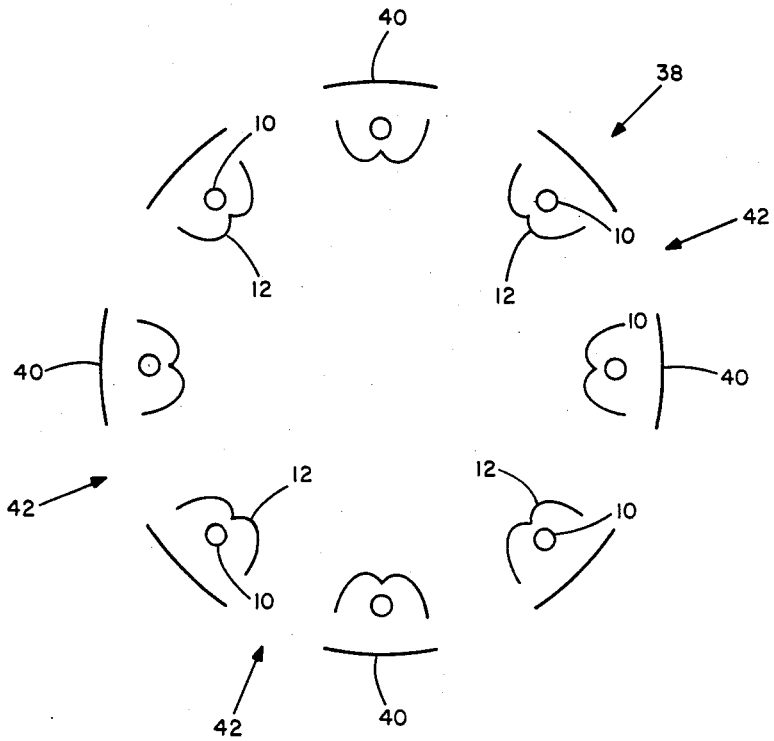
FIG. 6 is a schematic of an omnidirectional modulation system employing the compound collection/beamforming system of FIG. 1.

A modulated directional radiation system has been described. However, the compound collection beamforming system 12 can be used as a building block for other systems. FIG. 6 illustrates an omnidirectional modulation radiation system schematically. It includes a plurality of sources 10 the outputs from which are formed into beams by a like plurality of compound collection/beamforming systems 12 like that of FIG. 1. The entire plurality of compound collection/beamforming systems 12 is surrounded by a squirrel cage modulator 38 so that at the position of the modulator illustrated in FIG. 6 no radiation is emitted. When the modulator is rotated to a position where the transparent sections 42 are in front of the compound collection/beamforming systems 12, all radiation is emitted. An alternative to this arrangement is to employ one squirrel cage modulator for each source as in FIG. 1 rather than one for all sources.

Figure 7:
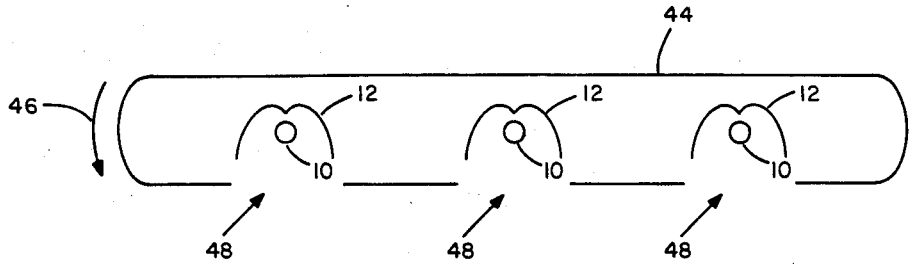
FIG. 7 is a schematic of a modulation system using a belt modulator and compound collection/beamforming systems like that of FIG. 1.
Figure 8:
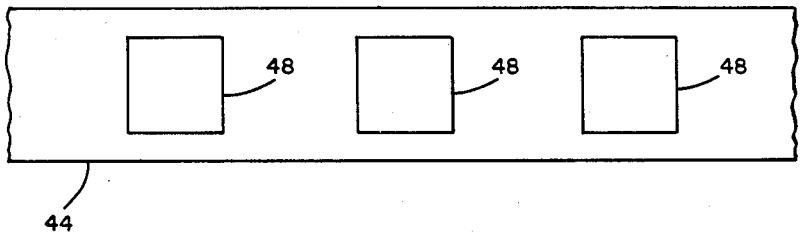
FIG. 8 is an illustration of a belt modulator used in the modulation system of FIG. 7.

Another embodiment is illustrated in FIG. 7. This embodiment also utilizes a plurality of radiation sources 10 and compound collection/beamforming systems 12. These are modulated by a belt modulator 44 which revolves in front of the sources as illustrated by arrow 46. As shown in FIG. 8, belt modulator 44 is a continuous loop belt having transparent portions or cutouts 48 therein. When belt modulator 44 is rotated in front of the sources, it alternatively blocks and unblocks the radiation.

Figure 9:
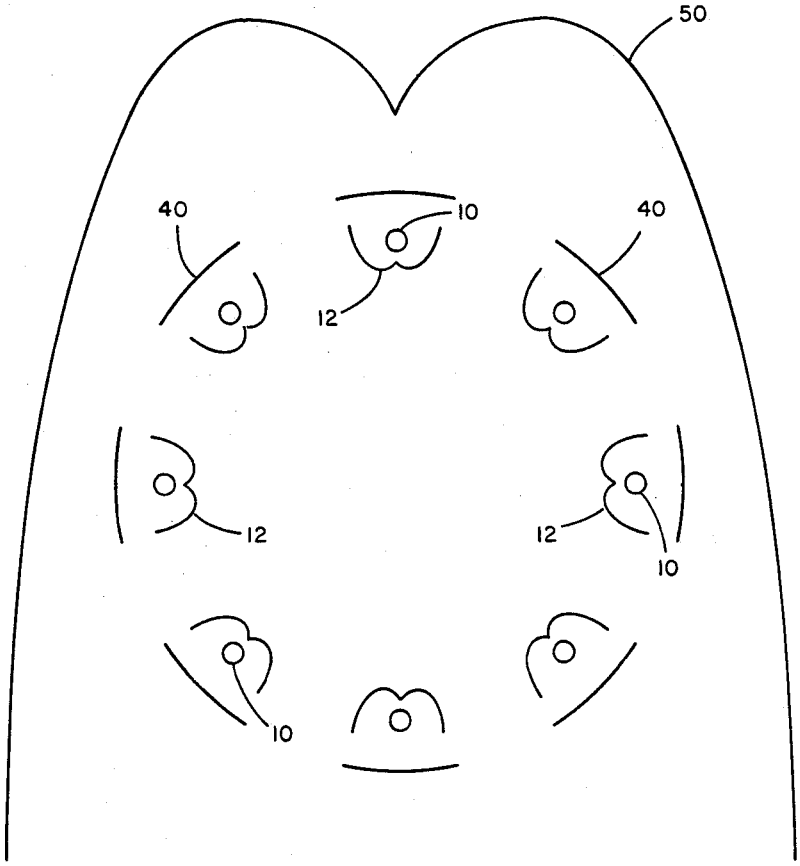
FIG. 9 is another embodiment of a modulation system employing compound collection/beamforming systems as illustrated in FIG. 1.

FIG. 9 illustrates yet another modulated radiation system employing the compound collection/beamforming system 12 of FIG. 1. This embodiment is like that of FIG. 6 with the addition of another compound collection/beamforming system 50 configured like the compound collection/beamforming systems 12. This provides large amounts of modulated radiation which might not be obtainable with a single compound collection/beamforming system 12 because of practical physical constraints on the size of the radiation sources 10.

The embodiments previously described generally use electrically heated blackbody sources 10 for infrared systems, however, arc lamps or selective emitters may be employed instead and instead of using mechanical modulators, such as the described squirrel cage and belt modulators, the sources may be electrically modulated.

Although only single modulators have been described, plural modulators may be employed. For example, in the embodiment of 6, a second squirrel cage modulator can be used. This would surround the modulator 38 and could rotate in the same direction as modulator 38 or in the opposite direction. Likewise in the embodiment of FIG. 7, plural belt modulators can be employed. These also can rotate in the same or opposite directions. Thus, it is to be understood that the embodiments shown are to be regarded as illustrative only and that many variations and modifications can be made without departing from the principles of the invention herein disclosed and defined by the appended claims.

We claim:

1. A radiation system, comprising:

a plurality of sources of radiation;

a like plurality of compound collection/beamforming systems each of which is disposed for receiving radiation from a corresponding one of said sources and each forms said radiation from each corresponding source into a beam of predetermined configuration radiated along an optical axis of the compound collection/beamforming system for each corresponding source, each of said compound collection/beamforming systems including an elevation collector/beamformer and an azimuth collector/beamformer, wherein each compound collection/beamforming system points in a different direction;

each elevation collector/beamformer being a compound parabolic concentrator;

means for modulating the beams of radiation emitted by said compound collection/beamforming systems; and an additional compound collection/beamforming system for collecting the modulated radiation from said plurality of modulated beams of radiation and forming it into a larger, more intense beam of radiation.

2. A radiation system as defined in claim 1, wherein each azimuth collector/beamformer is configured in the form of first and second curves having a dividing line at a point where a line tangential to each source of radiation is at an angle ($\theta_a$) with the longitudinal axis of the compound collection/beamforming system, where $\theta_a$ is one half the beamwidth of the beam in azimuth, each first curve being in closer proximity to said source envelope.

3. An radiation system as defined in claim 2, wherein said first curve is determined in accordance with the formula:

$$\rho = R_a(\theta + \theta_d)\ 0 \leqq \theta \leqq \theta_a + \pi/2$$

and said second curve is determined in accordance with the formula:

$$\rho = R_a\left[\frac{\theta + \theta_a + 2\theta_d + \pi/2 - \mathrm{Cos}(\theta - \theta_a)}{1 + \mathrm{Sin}(\theta - \theta_a)}\right]$$

$$\theta_a + \pi/2 \leqq \theta \leqq \frac{3\pi}{2} - \theta_a$$

where $\theta$ is the angle measured from the longitudinal axis to a radius of the source, $\rho$ is the distance from the end of a radius to the point of interest, and $\theta_d$ is determined from the formula:

$$\theta_d = \sqrt{\frac{R_2^2}{R_a^2} - 1} - \mathrm{Cos}\frac{-1R_a}{R_2}$$

where, $R_2$ is a scaler from the center of the source to the cusp of the azimuth collector/beamformer along the longitudinal axis, and $R_a$ is the radius of the source.

4. A radiation system as defined in claim 1, wherein each of said sources of radiation is substantially cylindrical.

5. A radiation system as defined in claim 2, wherein each of said radiation sources includes a source which emits radiation and an envelope in which said source is disposed.

6. A radiation system as defined in claim 5, wherein each of said compound collection/beamforming systems includes means for collecting substantially all of the tangential rays emanating from its respective source and forming them into said beam of predetermined configuration.

7. A radiation system as defined in claim 6, wherein each of said azimuth collector/beamformers is configured in the form of first and second curves having a dividing line at a point where a line tangential to said respective source of radiation is at an angle ($\theta_a$) with the optical axis of the compound collection/beamforming system where $\theta_a$ is one half the beamwidth of the beam in azimuth, said first curve being in closer proximity to said source envelope than said signal second curve.

8. A radiation system as defined in claim 7, wherein said first curve is determined in accordance with the formula:

$$\rho = R_a(\theta + \theta_d)\ 0 \leqq \theta \leqq \theta_a + \pi/2$$

and said second curve is determined in accordance with the formula $$\rho = R_a\left[\frac{\theta + \theta_a + 2\theta_d + \pi/2 - \mathrm{Cos}(\theta - \theta_a)}{1 + \mathrm{Sin}(\theta - \theta_a)}\right]$$

$$\theta_a + \pi/2 \leqq \theta \leqq \frac{3\pi}{2} - \theta_a$$

where $\theta$ is the angle measured from the longitudinal axis to a radius of the source, $\rho$ is the distance from the end of a radius to the point of interest, and $\theta_d$ is determined from the formula:

$$\theta_d = \sqrt{\frac{R_2^2}{R_a^2} - 1} - \mathrm{Cos}\frac{-1R_a}{R_2}$$

where, $R_2$ is a scaler from the center of the source to the cusp of the azimuth collector/beamformer along the longitudinal axis, and $R_a$ is the radius of the source.

9. A radiation system as defined in claim 8, wherein each of said plurality of sources of radiation being contained within a corresponding said compound collection/beamforming system.

* * * * *